US010961643B2

(12) United States Patent
Deguchi et al.

(10) Patent No.: US 10,961,643 B2
(45) Date of Patent: Mar. 30, 2021

(54) THIN WOVEN FABRIC HAVING SUPERIOR COMFORT

(71) Applicant: ASAHI KASEI KABUSHIKI KAISHA, Tokyo (JP)

(72) Inventors: Junko Deguchi, Tokyo (JP); Koichi Kai, Tokyo (JP)

(73) Assignee: ASAHI KASEI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/539,044

(22) PCT Filed: Dec. 25, 2015

(86) PCT No.: PCT/JP2015/086379
§ 371 (c)(1),
(2) Date: Jun. 22, 2017

(87) PCT Pub. No.: WO2016/104776
PCT Pub. Date: Jun. 30, 2016

(65) Prior Publication Data

US 2017/0370031 A1 Dec. 28, 2017

(30) Foreign Application Priority Data

Dec. 25, 2014 (JP) ..... JP2014-263224

(51) Int. Cl.
*D03D 15/10* (2006.01)
*D03D 15/00* (2021.01)
(Continued)

(52) U.S. Cl.
CPC ..... *D03D 15/58* (2021.01); *D01F 8/14* (2013.01); *D03D 13/008* (2013.01); *D03D 15/33* (2021.01);
(Continued)

(58) Field of Classification Search
None
See application file for complete search history.

(56) References Cited

U.S. PATENT DOCUMENTS 2,828,528 A * 4/1958 Gajjar ..... D06M 11/38 28/167
4,230,036 A * 10/1980 Groome ..... B29D 99/0035 100/176

(Continued)

FOREIGN PATENT DOCUMENTS

JP 9-256224 9/1997
JP 10-317239 12/1998

(Continued)

OTHER PUBLICATIONS

Machine translation of JP 2009013511, Kunisada et al. (Year: 2009).*

(Continued)

*Primary Examiner* — Shawn Mckinnon
(74) *Attorney, Agent, or Firm* — Finnegan, Henderson, Farabow, Garrett & Dunner, L.L.P.

(57) ABSTRACT

Provided is a fabric for use as sportswear, the side fabric of a futon or the inner bag thereof that has superior heat retention and a soft texture despite being lightweight and thin. The fabric is a thin fabric having a fabric density of 15 g/m$^2$ to 50 g/m$^2$ in which thermoplastic synthetic fibers having fineness of 5 dtex to 30 dtex are arranged in at least a portion of the warp yarn or weft yarn, wherein the average deviation of the coefficient of friction on at least one side of the fabric is 0.008 to 0.05, and the value of Qmax of that one side of the fabric is 85 W/m$^2$·° C. to 125 W/m$^2$·° C.

5 Claims, 1 Drawing Sheet

(51) Int. Cl.

| | |
|---|---|
| ***D06M 15/643*** | (2006.01) |
| ***D01F 8/14*** | (2006.01) |
| ***D06C 15/08*** | (2006.01) |
| ***D03D 15/08*** | (2006.01) |
| ***D03D 1/00*** | (2006.01) |
| ***D03D 15/58*** | (2021.01) |
| ***D03D 13/00*** | (2006.01) |
| ***D03D 15/33*** | (2021.01) |
| ***D03D 15/44*** | (2021.01) |
| ***D03D 15/56*** | (2021.01) |

(52) U.S. Cl.
CPC ..... *D03D 15/44* (2021.01); *D03D 15/56* (2021.01); *D06C 15/08* (2013.01); *D06M 15/643* (2013.01); *D03D 1/00* (2013.01); *D10B 2331/04* (2013.01); *D10B 2501/00* (2013.01)

(56) References Cited

U.S. PATENT DOCUMENTS

| | | | | |
|---|---|---|---|---|
| 2011/0033687 | A1* | 2/2011 | Deguchi | D03D 1/0041 428/219 |
| 2011/0302689 | A1* | 12/2011 | Tone | D03D 13/008 2/85 |
| 2013/0035014 | A1 | 2/2013 | Tone et al. | |
| 2016/0122912 | A1* | 5/2016 | Takayanagi | D03D 15/00 139/420 R |

FOREIGN PATENT DOCUMENTS

| | | | |
|---|---|---|---|
| JP | 2002-220718 | | 8/2002 |
| JP | 2003-171814 | | 6/2003 |
| JP | 2009013511 | * | 1/2009 |
| JP | 2011-99179 | | 5/2011 |
| JP | 4992577 B2 | | 8/2012 |

OTHER PUBLICATIONS

Wikipedia, https://en.wikipedia.org/wiki/Glass_transition, page visited on Mar. 28, 2019 (Year: 2019).*

Pai et al., "Effects of Moisture on Thermal and Mechanical Properties of Nylon 6,6", Advances in Polymer Technology, vol. 9, No. 2, pp. 157-163 (Year: 1989).*

International Search Report issued by the Japan Patent Office in counterpart International Application No. PCT/JP2015/086379, dated Mar. 22, 2016 (2 pages).

Written Opining of the International Searching Authority issued by the Japan Patent Office in counterpart International Application No. PCT/JP2015/086379, dated Mar. 22, 2016 (5 pages).

Supplementary European Search Report for corresponding EP Application No. 15873344.4 dated Dec. 1, 2017.

* cited by examiner

THIN WOVEN FABRIC HAVING SUPERIOR COMFORT

This application is a National Phase of International Application No. PCT/JP2015/086379, filed Dec. 25, 2015.

TECHNICAL FIELD

The present invention relates to a thin woven fabric used for the side fabric of a down jacket, thin sportswear such as a windbreaker, a ticking for sleeping bags and futons, or fabric for the inner bag thereof. More particularly, the present invention relates to a thin woven fabric, which has an improved sense of coldness when contacted, demonstrates superior heat retention when used, is lightweight and extremely thin, but demonstrates superior tear strength and wear resistance, as well as a fabric of sportswear or a ticking for a futon, etc., that uses that thin woven fabric or a woven fabric for the inner bag thereof.

BACKGROUND ART

Sportswear woven fabric has conventionally been desired to be lightweight and thin while demonstrating superior tear strength from the viewpoints of being comfortable to wear and being easy to move in when worn. In addition, in applications for futon ticking fabrics such as futon covers or futon inner bags, the fabric is desired to be lightweight and thin while having a high level of tear strength in order to reduce the burden when sleeping and in order to be used in sleeping bag applications. In the case of producing a lightweight, thin woven fabric, since it is effective to use yarn having a small fineness when composing the fabric and carry out calendaring under harsh conditions, there were the problems of the fabric feeling extremely cold when touched or worn, and the fabric easily allowing heat to escape due to the small size of the air layer in the fabric, thereby resulting in inferior heat retention. In the case of fabric for sportswear, and particularly down jackets, the ticking fabric of sleeping bags or down-filled futons, or the inner bags of down-filled futons, although the fabric is required to be down-proof in addition to being lightweight and thin, it is necessary for the fabric to employ a dense structure in order to satisfy the requirement of being down-proof, and since this normally resulted in carrying out calendaring under harsh conditions, there was the problem of the woven fabric becoming hard.

Patent Document 1 indicated below discloses a lining having an exothermic energy index indicative of moisture adsorptive heat generation performance of 5 or more and a surface contact cold sensation (Qmax) of 0.12 W/cm$^2$ or less. However, since this lining has a large basis weight (babric density or weight per unit area) and reduces contact cold sensation by being provided with small surface irregularities, it cannot be said to be a fabric that is extremely thin, retains heat and has a favorable texture.

In addition, Patent Document 2 indicated below discloses a windbreaker that uses a fabric having an exothermic energy index indicative of moisture adsorptive heat generation performance of 5 or more and a contact cold sensation (Qmax) of the lining surface of 0.1 W/cm$^2$ or less. However, it cannot be said that since the lining of this windbreaker has large fineness, is extremely thin and retains heat, such a fabric is a woven fabric having favorable texture.

PRIOR ART DOCUMENTS

Patent Documents

[Patent Document 1] Japanese Unexamined Patent Publication (Kokai) No. 2002-220718

[Patent Document 2] Japanese Unexamined Patent Publication (Kokai) No. 2003-171814

SUMMARY OF THE INVENTION

Problems to be Solved by the Invention

An problem to be solved by the present invention is to provide sportswear, futon ticking woven fabric or inner bag thereof which, despite being extremely lightweight and thin, demonstrates superior heat retention and has a soft texture.

Means for Solving the Problems

As a result of conducting extensive studies to solve the aforementioned problems, the inventor of the present invention found that, by using specific highly fine fibers and carrying out specific processing with a specific weave structure, heat retention, soft texture and adequate tear strength can be demonstrated even in a thin, lightweight woven fabric, thereby leading to completion of the present invention.

Namely, the present invention is as indicated below.

[1] A thin woven fabric composed of warp yarns and weft yarns and having a basis weight of 15 g/m$^2$ to 50 g/m$^2$ wherein thermoplastic synthetic fibers having fineness of 5 dtex to 30 dtex are arranged in at least a portion of the warp yarns or weft yarns, and wherein the average deviation of the coefficient of friction on at least one side of the fabric is 0.008 to 0.05, and the value of Qmax of that one side of the fabric is 85 W/m$^2$·° C. to 125 W/m$^2$·° C.

[2] The thin woven fabric described in [1] above, wherein a silicone resin is attached thereto.

[3] The thin woven fabric described in [1] or [2] above, wherein the filling rate of the thin woven fabric is 35% to 65%.

[4] The thin woven fabric described in any of [1] to [3] above, wherein the tear strength of the thin woven fabric is 8 N to 20 N.

[5] The thin woven fabric described in any of [1] to [4] above, wherein a yarn flattening index X of yarns composing the outermost surface on the surface side of the thin woven fabric having higher smoothness is 0.75 or less, and a yarn flattening index Y of yarns not composing the outermost surface is 0.8 to 1.1.

[6] A method for producing the thin woven fabric described in any of [1] to [5] above, comprising the step of:

weaving a fabric, and calendaring the woven fabric, under conditions such that, when glass transition temperature of the thermoplastic synthetic fibers is defined as TG (° C.), melting point is defined as TM (° C.), calendar roll temperature is defined as T (° C.), calendar roll pressure is defined as P (t/150 cm) and calendar roll speed is defined as S (m/min), then the calendaring index defined by $\{T-(TG+TM)/2\}/2+\{(P-25)/5\}+\{(10-S)/2\}$ is −12 to 12 to produce the fabric.

[7] The method described in [6] above, wherein the calendar roll temperature is (TG+TM)/2−20 to (TG+TM)/2+30 (° C.).

Effects of the Invention

The thin woven fabric of the present invention is a smooth, soft and comfortable fabric which, despite being extremely lightweight and thin, has superior comfort when contacted and retains heat when worn or used. The fabric also demonstrates superior tear strength and abrasion strength and has superior down-proofing properties, thereby making it preferable as a fabric for use in down jackets, windbreakers and other types of sportswear, as a ticking for sleeping bags and futons, or as fabric for an inner bag thereof. Namely, despite using extremely fine yarn, the woven thin fabric of the present invention retains heat, is soft and has a superior feel on the skin, and is provided with adequate tear strength.

EMBODIMENTS FOR CARRYING OUT THE INVENTION

Figure 1:
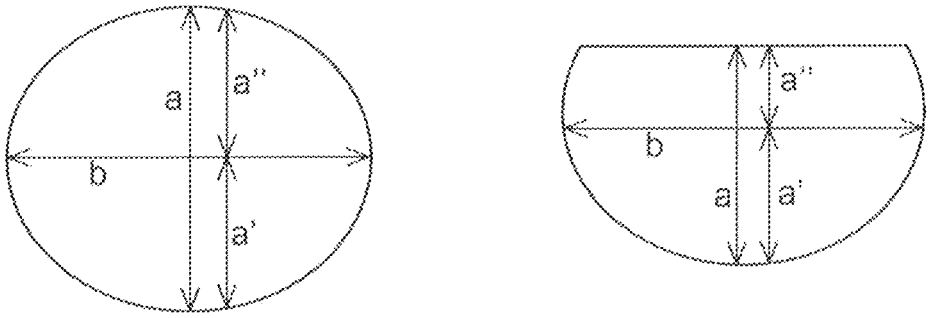
FIG. 1 is an explanatory drawing of yarn flattening index.

The following provides a detailed explanation of embodiments of the present invention.

The thin woven fabric of the present embodiment is a thin fabric in which thermoplastic synthetic fibers having a fineness of 5 dtex to 30 dtex are arranged in at least a portion of the warp yarns or weft yarns of the fabric. The thermoplastic synthetic fibers may be arranged in either of the warp yarns or weft yarns, or may be arranged in both the warp yarns and weft yarns. There are no particular limitations on the thermoplastic synthetic fibers referred to in the present embodiment, and polyester-based fibers, polyamide-based fibers or polyolefin-based fibers and the like are used preferably. Examples of polyester-based fibers include copolymerized polyester-based fibers having for a main component thereof polyethylene terephthalate, polytrimethylene terephthalate, polybutylene terephthalate or polyethylene naphthalate, while examples of polyamide-based fibers include Nylon 6, Nylon 66 and third component copolymers thereof. Examples of polyolefin-based fibers include polypropylene and polyethylene. Among these, polyester-based fibers are preferable from the viewpoints of heat resistance and dyeability in particular, while polyamide-based fibers are preferable from the viewpoints of strength and softness. In addition, fibers other than thermoplastic synthetic fibers may be used in a portion of the fabric.

The fineness of the fibers (yarns) arranged in a portion of the warp yarns or weft yarns of the fabric of the present embodiment is required to be 5 dtex to 30 dtex, and is preferably 7 dtex to 24 dtex and more preferably 7 dtex to 18 dtex. If fineness exceeds 30 dtex, the yarn becomes excessively thick, and in the case of weaving into a fabric, causes the fabric to become thick and hard and prevents it from demonstrating the desired effects. In the case fineness is smaller than 5 dtex, it is difficult to attain tear strength of 8 N or more even if the fabric structure is adjusted and subjected to resin processing, thereby making it difficult for the fabric to withstand practical performance. Single yarn fineness is preferably 0.5 dtex to 2.5 dtex and more preferably 0.7 dtex to 2.0 dtex.

There are no particular limitations on the cross-sectional shape of the synthetic fiber multifilament yarn, and yarn having a circular cross-section or irregularly shaped cross-section is used. Although examples of irregularly shaped cross-sectional shapes include Y-shaped, cross-shaped, W-shaped or V-shaped cross-sections, a circular cross-section is used preferably in terms of strength.

The aforementioned thermoplastic synthetic fibers are only required to be used in at least a portion of the warp yarns or weft yarns, or the entire fabric may be composed of these yarns. Synthetic fibers other than the thermoplastic synthetic fibers, regenerated fibers or cellulose fibers and the like may be blended in as yarn other than the aforementioned thermoplastic synthetic fibers, and although thermoplastic synthetic fibers having fineness outside the aforementioned range may also be blended, the blend ratio of these fibers is preferably 30% or less and more preferably 10% or less. In addition, in order to obtain the fabric having a dense structure of the present invention, variations in the fineness of the fibers that respectively compose the warp yarn and weft yarn are preferably low, and the fineness ratio between the fibers having the maximum fineness and fibers having the minimum fineness with respect to the warp yarn and weft yarn, respectively, is preferably 2.0 or less, more preferably 1.8 or less, even more preferably 1.5 or less, and particularly preferably 1.2 or less. The fabric is most preferably composed only of fibers having a single fineness.

The woven fabric of the present embodiment is characterized in that the average deviation of the coefficient of friction on at least one surface thereof is 0.008 to 0.050. The average deviation of the coefficient of friction of the fabric is measured according to the standard conditions of the KES-FB4 manufactured by Kato Tech Co., Ltd., the average value of n=3 measurements each in the longitudinal direction and lateral direction is determined, and the larger value of the average value in the longitudinal direction or lateral direction is used for the value of average deviation. In the case the value is larger than 0.050, this means that fluctuations in the coefficient of friction of the fabric are large, resulting in a rough feel, thereby making this unsuitable. In the case the value is smaller than 0.008, the texture becomes excessively smooth and a cold sensation becomes stronger, thereby making this undesirable. The average deviation of the coefficient of friction is more preferably 0.010 to 0.045 and even more preferably 0.012 to 0.040.

In the case of wearing the woven fabric as an article of clothing, the side for which the average deviation of the coefficient of friction is 0.008 to 0.50 is arranged on the side close to the skin.

It is necessary to adjust yarn fineness and density to make the average deviation of the coefficient of friction to be within the range of 0.008 to 0.050. Although fineness is preferably within the aforementioned range, within a range in which fineness is comparatively small at 5 dtex to 10 dtex, excessively high density results in excessive smoothness, thereby making this undesirable, while within a range in which fineness is comparatively large at 25 dtex to 30 dtex, excessive density results in an excessively heavy and hard fabric, which is also undesirable. In addition, conditions in which density is low in any of these cases result in large surface irregularities and increased toughness, thereby making such conditions undesirable.

Calendering conditions in the processing step are extremely important for making the average deviation of the coefficient of friction to be within the range of 0.008 to 0.050. In the case of a thin woven fabric, and particularly in applications using wadding such as down, calendaring processing is frequently used to prevent escape of down, and by using calendaring to apply pressure to surface fibers using heat, air permeability is suppressed and escape of down is prevented. However, excessive calendaring causes the surface to become extremely smooth, and since contact area with the skin increases during contact, a cold sensation is felt more strongly, thereby making this undesirable. A fabric that has a reduced cold sensation, does not feel rough and exhibits little escape of down can be obtained by carrying out calendaring processing under special conditions to control the surface status of the woven fabric.

In the thin fabric of the present embodiment, despite having a smooth outermost surface, yarn other than that of the outermost surface is preferably not flattened. As a result, the filling rate of the fabric can be prevented from becoming excessively large, resulting in a fabric having superior heat retention. More specifically, when the yarn flattening index of yarn composing the outermost surface on the side of the surface having high smoothness is defined as X, and the flattening index of yarn that does compose the outermost surface is defined as Y, then X is 0.75 or less and Y is 0.80 to 1.0. An explanation of yarn flattening index is provided in FIG. 1. When the maximum diameter of a yarn cross-section is defined as b, and a line segment perpendicular to b that divides b into two equal portions is defined as a, then a is divided into a' and a" (where, a'>a") at the intersection with b. At this time, the value of a"/a' is taken to be the flattening index of the yarn. It is necessary to control calendaring conditions in order to create a state in which, despite the outermost surface of the fabric being smooth, yarn other than yarn on the outermost surface is not flattened.

More specifically, it is necessary to control the type, pressure, temperature and speed of the calendar roll. This roll preferably combines a metal roll and an elastic roll. Examples of an elastic roll include a paper roll, cotton roll and plastic roll. Combining with an elastic roll enables the heat and pressure of the metal roll to act uniformly over the entire fabric. The proper calendaring (roll) temperature varies according to the material that composes the fabric, and when the glass transition temperature of the material is defined as TG (° C.) and the melting point is defined as TM (° C.), then the calendaring (roll) temperature is preferably (TG+TM)/2−20° C. to (TG+TM)/2+30° C., more preferably (TG+TM)/2−20° C. to (TG+TM)/2+20° C., and even more preferably (TG+TM)/2−15° C. to (TG+TM)/2+15° C. In the case the fabric is a blend of a plurality of materials, the fiber material on the side contacted by the calendar metal surface that has the lowest glass transition temperature and melting point is used. If the calendaring temperature is excessively high, the fabric surface becomes hard and slippery and a cold sensation increases, thereby making this undesirable. If the calendaring temperature is excessively low, air permeability increases and the surface feels rough, thereby also making this undesirable. Pressure is preferably applied at 5 tons to 50 tons, and more preferably at 15 tons to 40 tons, per 150 cm of fabric width. If the excessive high pressure is applied, the surface becomes slippery and cold sensation becomes large, thereby making this undesirable. On the other hand, If excessive low pressure is applied, air permeability increases and the surface feels rough, thereby making this undesirable. Speed is also important, and processing is preferably carried out at 5 m/min to 30 m/min, more preferably at 8 m/min to 20 m/min, and particularly preferably at 10 m/min to 18 m/min.

When roll temperature is defined as T (° C.), pressure is defined as P (t/150 cm) and speed is defined as S (m/min), then the calendaring index calculated as $\{T-(TG+TM)/2\}/2+\{(P-25)/5\}+\{(10-S)/2\}$ is preferably −12 to 12 and more preferably −10 to 10. As a result of processing under these conditions, the tradeoff between air permeability and texture can be overcome, thereby making it possible to realize a softer texture and reduce cold sensation while suppressing air permeability.

Another example of a preferable condition is processing under conditions of a calendaring index of −10 to 0 and rapidly cooling the fabric. As a result of suddenly cooling to 50° C. or lower, the tradeoff between air permeability and texture can be overcome, thereby making it possible to realize a softer texture and reduce cold sensation while suppressing air permeability. A method consisting of contacting with a cooling device or cooling roll is used for cooling.

Furthermore, in the case of using processed yarn obtained by subjecting a fabric to false-twisting processing and the like, since the yarn per se is bulky and has s certain thickness, it is preferable to carry out calendaring processing under conditions that are harsher than normal, and the calendaring index is preferably made to be 0 to 12. Calendering is preferably carried out two to three times, and in the case of carrying out a plurality of times, it is appropriate to gradually weaken calendaring conditions.

In the case of fabric having fineness of 12 dtex or smaller, it is also preferable to carry out calendaring two to three times from the viewpoint of controlling air permeability.

The fabric of the present invention is unlikely to produce a cold sensation when touched. The cold sensation when touched can be evaluated by measuring the Qmax value using the ThermoLab II manufactured by Kato Tech Co., Ltd., and the Qmax value of the thin fabric of the present embodiment is 85 $W/m^{2\cdot}$° C. to 125 $W/m^{2\cdot}$° C., preferably 85 $W/m^{2\cdot}$° C. to 120 $W/m^{2\cdot}$° C., and more preferably 90 $W/m^{2\cdot}$° C. to 120 $W/m^{2\cdot}$° C. The Qmax value closely correlates with the thermal conductivity of the material and the surface status of the fabric, and particularly with the smoothness of the fabric. In the case Qmax is smaller than 85 $W/m^{2\cdot}$° C., although there is no cold sensation, minute surface irregularities on the surface of a fabric having high smoothness become excessively large and feel on the skin becomes poor, thereby making this undesirable. In the case Qmax exceeds 125 $W/m^{2\cdot}$° C., cold sensation becomes prominent, thereby making this undesirable. Since contact cold sensation is greatly affected by surface irregularities, the aforementioned special calendaring conditions are used in the present embodiment so that the calendaring index is preferably −12 to 12 and more preferably −10 to 10.

The thin woven fabric of the present embodiment has a basis weight (or fabric density or weight per unit area) of 15 $g/m^2$ to 50 $g/m^2$, preferably 15 $g/m^2$ to 40 $g/m^2$ and more preferably 20 $g/m^2$ to 35 $g/m^2$. The basis weight is required to be 50 $g/m^2$ or less in order to ensure a feeling of lightweight and softness when using the fabric as a fabric of sportswear or a ticking for a futon, and particularly as a fabric of a down jacket or a ticking for down-filled futon. If the basis weight is 15 $g/m^2$ or more, tear strength can be made to be 8 N or more by adjusting the fabric structure and subjecting to silicone resin or other resin processing.

The thickness of the thin fabric of the present embodiment at a contact pressure of 5 $g/cm^2$ is 0.035 mm to 0.080 mm, preferably 0.040 mm to 0.075 mm and even more preferably 0.040 mm to 0.070 mm. Thickness is required to be 0.080 mm or less in order to ensure a feeling of lightweight and softness when using the fabric as a fabric of sportswear or a ticking for a futon, and particularly as a fabric of a down jacket or a ticking for down-filled futon.

The filling rate of the thin fabric of the present embodiment is preferably 35% to 65% and more preferably 40% to 60%. Filling rate refers to the percentage of fibers occupying a space, and can be calculated based on basis weight, thickness and the density of fibers composing the fabric. As filling rate increases, although this has the effect of making the fibers dense and suppressing air permeability, this also causes the texture to become hard and the amount of escaped heat to increase.

The inventors of the present invention found that making the filling rate, as calculated from the thickness of the fabric measured at a specific contact pressure, to be within a specific range is effective for achieving the object of the present invention. In the present embodiment, making the filling rate to be 35% to 65% makes it possible to realize a structure that suppresses air permeability, prevents texture from becoming excessively hard, and is resistant to the escape of heat.

Filling rate is also affected by calendaring conditions. Filling rate can be made to be within the range of 35% to 65% by optimizing the calendaring index. The calendaring index is preferably −12 to 12 and more preferably −10 to 10.

In the case of using the woven fabric of the present embodiment in a down jacket or a ticking for a down-filled futon, although air permeability is preferably 0.3 cc/cm$^2$·sec to 1.5 cc/cm$^2$·sec in order to satisfy the requirement for being down-proof, since it is necessary to realize a dense structure with narrow yarn in order for the fabric to be lightweight and have air permeability of 0.3 cc/cm$^2$·sec to 1.5 cc/cm$^2$·sec, it is susceptible to being hard and having a structure that is difficult to move in. A fabric can be realized that demonstrates high tear strength while still being lightweight and having low air permeability by employing a structure having unconstrained points at two or three consecutive locations and subjecting to silicone resin or other resin processing. Air permeability is particularly preferably 0.5 cc/cm$^2$·sec to 1.0 cc/cm$^2$·sec.

The woven fabric of the present embodiment preferably has high tear strength despite being a thin fabric. Tear strength in the present invention refers to that measured in accordance with Method D of JIS-L-1096:8.15.5 (pendulum method), and tear strength of about 8 N to 20 N is preferable in order for the fabric to withstand practical use such as a fabric of sportswear or a ticking for a futon. If tear strength is 8 N or more, there is no risk of tearing during use, while if tear strength is 20 N or less, desired effects are demonstrated with a thin fabric using thin yarn, making the fabric useful in terms of practical use.

The woven fabric of the present embodiment preferably has a specific structure and is subjected to silicone resin or other resin processing in order to demonstrate tear strength of 8 N to 20 N despite being a lightweight, thin fabric. Although resin processing was conventionally considered to result in problems such as a hard texture or inferior durability, in the present embodiment, as a result of carrying out resin processing with a silicone-based resin on a small-fineness, high-density fabric, in addition to significantly improving the tear strength of the fabric, a resin coating can be imparted that has a soft texture and superior durability. This is because, in contrast to conventional resin processing being carried out for primarily for the purpose of forming a coating on a fabric surface, in the present embodiment, the resin of the silicone-based resin is coated for the purpose of improving slippage between highly fine fibers.

Although there are no particular limitations on the silicone-based resin provided it is a resin that contains silicone, from the viewpoints of durability and processability in particular, an emulsion of a modified silicone resin and a surfactant is preferable. Specific examples of modified silicone resins include, but are not limited to, Nicca Silicon DM-100E manufactured by Nicca Chemical Co., Ltd., Silicolan EC and Paladin MB manufactured by Keihin Chemical Co., Ltd., High Softer KR-50 manufactured by Meisei Chemical Works, Ltd., and Solusoft WA manufactured by Clariant Japan K.K. The surfactant may be suitably selected in consideration of the ionicity of the silicone resin.

The improvement in tear strength resulting from coating a silicone-based resin onto the thin woven fabric is due to an improvement in yarn slippage attributable to resin processing with the silicone-based resin. In general, although tearing of a fabric ends up occurring at comparatively low stress when stress concentrates at the location where the fabric is torn, stress at a point where the fabric is torn is dissipated due to yarn slippage attributable to resin processing with the silicone-based resin, and as a result thereof, tear strength can be made to be 8 N or more.

A special structure is employed by the fabric in order to enhance the effect of yarn slippage, or in other words, the number of intersection points between the warp yarn and weft yarn of the fabric is 23,000/inch$^2$ to 70,000/inch$^2$ and preferably 27,000/inch$^2$ to 62,000/inch$^2$. The number of intersection points of the warp yarn and weft yarn of the present fabric refers to the number of locations where the warp yarn and weft yarn intersect per square inch, and in the case of taffeta or rip-stop taffeta, can be represented as warp yarn density (number of warp yarns/inch)×weft yarn density (number of weft yarns/inch). In the case of the number of intersection points between the warp yarn and weft yarn is less than 23,000/inch$^2$, gaps between yarns in the fabric become large and it becomes difficult to make air permeability to be 1.5 cc/cm$^2$·sec or less. In addition, resistance to seam slippage also decreases, which may result in problems with sewability. If the number of intersection points between the warp yarn and weft yarn exceeds 70,000/inch$^2$, texture becomes hard and tear strength does not improve even if subjected to resin processing, thereby making it difficult to achieve the object of the present invention.

The molecular weight of the thermoplastic synthetic fibers used in the fabric of the present invention is preferably high. Since the molecular weight of the polymer that composes the fabric can normally be expressed with viscosity, a high viscosity is desirable. For example, in the case of polyester-based fibers, intrinsic viscosity [η] is preferably 0.65 to 1.30 and more preferably 0.8 to 1.1. Here, intrinsic viscosity [η] refers to limiting viscosity measured in ortho-chlorophenol at 1% by weight, and by making intrinsic viscosity [η] to be 0.65 to 1.30, the target level of tear strength can be obtained even with the low fineness polyester-based fibers used in the present invention. If intrinsic viscosity [η] is 0.65 or more, yarn strength and yarn abrasion strength increase, and tear strength and abrasion strength are adequate particularly in the case of weaving yarn having a thin single yarn fineness into a fabric, while if intrinsic viscosity [η] is 1.3 or less, there is less susceptibility to the problem of the texture becoming hard in the case of weaving into a fabric. Polyester-based fibers in which intrinsic viscosity [η] is 0.65 to 1.30 for the warp yarns or weft yarns are used preferably, while polyester-based fibers in which intrinsic viscosity [η] is 0.65 to 1.30 for both the warp yarns and weft yarns are used more preferably.

In addition, in the case of polyamide-based fibers, relative viscosity is preferably 2.5 to 3.5. Here, relative viscosity refers the value obtained by measuring solution relative viscosity using an Ostwald viscometer at 25° C. by dissolving a polymer or prepolymer in 85.5% reagent grade concentrated sulfuric acid at a polymer concentration of 1.0 g/dl. If relative viscosity is 2.5 or more, yarn strength and yarn abrasion strength increase, and tear strength and abrasion strength are adequate particularly in the case of weaving yarn having a thin fineness into a fabric, while if relative viscosity is 3.5 or less, there is less susceptibility to the problem of the texture becoming hard in the case of weaving into a fabric. Polyamide-based fibers in which relative viscosity is 2.5 to 3.5 for the warp yarns or weft yarns are used preferably, while polyamide-based fibers in which relative viscosity is 2.5 to 3.5 for both the warp yarns and weft yarns are used more preferably.

Although there are no particular limitations on the weave structure (texture) of the fabric of the present embodiment, an arbitrary structure such as taffeta, rip-stop taffeta, twill or sateen can be used.

In the case of taffeta, since surface irregularities are smaller than other structures, the calendaring index is preferably within the range of −12 to 5. As a result, decreases in contact cold sensation can be inhibited.

In addition, in the case of rip-stop taffeta in particular, the uniqueness of the woven structure and the action of the silicone resin demonstrate mutually synergistic effects, and a 30% to 50% improvement in tear strength is observed relative to fabric not coated with resin. In the case of rip-stop taffeta, since two to three yarns are arranged overlapping the warp yarn or weft yarn, this superior effect is thought to be the result of the slip effect of the silicone resin being demonstrated remarkably easily. The size of the rip-stop checkered pattern is preferably 0.2 mm to 5 mm.

The amount of silicone-based resin coated onto the fabric in order to demonstrate the slip effect is preferably 0.1% by weight to 10.0% by weight and more preferably 0.5% by weight to 3.0% by weight, to the weight of the fabric. If the coated amount is 0.5% by weight to 3.0% by weight, there is less susceptibility to the occurrence of weave distortion and other defects, thereby making this more preferable. If the coated amount of silicone-based resin is within this range, tear strength is increased by 10% to 50% in comparison with the case of not coating with silicone resin.

Although there are no particular limitations on the method used to carry out resin processing, preferable examples thereof include a method consisting of processing using the DIP and NIP method after dyeing, a method consisting of processing using the exhaustion method, and a method consisting of processing by mixing in a coating agent. A processing method using the DIP and NIP method is used particularly preferably since the processing agent can be reliably adhered to the fabric surface in the final stage of the processing step. The temperature used to finish ordinary fabrics can be used for the drying temperature without any particular problems.

Resin processing with a silicone-based resin not only achieves the effect of improving tear strength, but also simultaneously achieves the effect of making texture smoother and softer. As a result of these effects, rough feel is eliminated and feel on the skin is favorable in the case of using in sportswear or a ticking for a futon.

The thin woven fabric of the present embodiment also has superior abrasion strength in addition to tear strength. Abrasion strength is evaluated according to the Martindale rub test using an abrasive opposing cloth for the hair canvas. Abrasion strength determined according to this method that is preferably equivalent to 10,000 times or more, and more preferably 15,000 times or more, can be said to provide adequate durability even in cases of using in sportswear applications such as down jackets or windbreakers. Abrasion strength is even more preferably equivalent to 20,000 times or more. A method consisting of using highly viscous polyamide-based or polyester-based fibers at a single fiber (filament) fineness of preferably 0.5 dtex to 2.5 dtex, and more preferably 0.7 dtex to 2.5 dtex, or subjecting the yarn or fabric to heat relaxation treatment, is effective for enhancing abrasion strength of a thin woven fabric.

There are no particular limitations on the weaving machine used when weaving the fabric, and a water jet loom, air jet loom or rapier loom can be used. Following weaving, the fabric can be subjected to scouring, relaxation, presetting and dyeing in accordance with ordinary methods, and additional function processing such as water repellency treatment, water absorption processing, antimicrobial treatment or deodorizing treatment can be imparted as necessary.

A woven fabric obtained in this manner is a comfortable fabric that demonstrates superior comfort when contacted, does not feel cold when worn or used, and retains heat to a certain extent despite being extremely lightweight and thin. Since the woven fabric also demonstrates superior tear strength and abrasion strength, has an extremely soft texture and demonstrates superior down-proofing properties, it is preferable for use in down jackets, windbreakers and other sportswear, in a ticking for sleeping bags and futons, or in the woven fabric for the inner bags thereof.

EXAMPLES

The following provides a detailed explanation of the present invention based on examples thereof.

Measured parameters and measurement methods used in the examples are as indicated below.

(1) Fiber Polymer Viscosity

Polyester-based fibers (yarns): Intrinsic viscosity [η] was indicated as limiting viscosity measured in ortho-chlorophenol at 1% by weight.

Polyamide-based fibers (yarns): Relative viscosity was obtained by measuring solution relative viscosity using an Ostwald viscometer at 25° C. by dissolving a polymer or prepolymer in 85.5% reagent grade concentrated sulfuric acid at a polymer concentration of 1.0 g/dl.

(2) Calendering Index

When glass transition temperature of the thermoplastic synthetic fibers is defined as TG (° C.), melting point is defined as TM (° C.), calendar roll temperature is defined as T (° C.), calendar roll pressure is defined as P (t/150 cm) and calendar roll speed is defined as S (m/min), then the calendaring index was defined as $\{T-(TG+TM)/2\}/2+\{(P-25)/5\}+\{(10-S)/2\}$. In the case of Nylon 6, TG was taken to be 47° C. and TM was taken to be 225°, in the case of Nylon 66, TG was taken to be 49° C. and TM was taken to be 267°, and in the case of polyester, TG was taken to be 68° C. and TM was taken to be 260°.

(3) Yarn Flattening Index

Micrographs of cross-sections of the fabric in the transverse and horizontal directions each were taken with an electronic microscope. When the maximum diameter of a yarn cross-section was defined as b, and a line segment perpendicular to b that divides b into two equal portions was defined as a, then a is divided into a' and a" (where, a'>a") at the intersection with b. At this time, the value of a"/a' is taken to be the flattening index of the yarn, and the average of five locations in the outermost yarn in the transverse and longitudinal directions each was determined. Five other random locations were also measured in the longitudinal and transverse directions each for yarn other than the outermost yarn followed by determination of the average thereof.

(4) Basis Weight (Fabric Density or Weight Per Unit Area)

Basis Weight was determined according to the weight per unit surface area in the standard state of the fabric in accordance with JIS-L-1096 8.4.2.

(5) Thickness

Thickness was measured using a thickness gauge manufactured by Peacock Ozaki Mfg. Co. Ltd. (dial thickness gauge: contact pressure: 5 g/cm$^2$) followed by determination of the average value of five measurements (n=5).

(6) Average Deviation of Coefficient of Friction

Average deviation of the coefficient of friction of the fabric was obtained by measuring according to the standard conditions of the KES-FB4 manufactured by Kato Tech Co., Ltd., the average value of n=3 measurements each in the longitudinal direction and lateral direction was determined, and the larger value of the average value in the longitudinal direction or lateral direction was used for the value of average deviation of the coefficient of friction.

(7) Cold Sensation (Qmax)

The value of Qmax was measured using the ThermoLab II manufactured by Kato Tech Co., Ltd. After humidifying a sample measuring 8 cm×8 cm for 24 hours in an environment at 20° C. and 65% relative humidity (RH), the maximum amount of heat instantaneously transferred when a hot plate heated to 30° C. was placed on the sample was measured. Units are in W/m$^2$·° C.

(8) Filling Rate

Filling rate was calculated based on filling rate=M/(10×d×T) when basis weight (g/m$^2$) is defined as M, fiber specific gravity (g/cm$^3$) is defined as d, and thickness (mm) is defined as T. Units are in %. Here, the filling rate was taken to be 1.14 in the case of Nylon 6, 1.14 in the case of Nylon 66 and 1.38 in the case of polyester.

(9) Tear Strength

Tear strength was measured in accordance with Method D (pendulum method) of JIS-L-1096 8.15.5.

(10) Abrasion Strength

Abrasion strength was measured in compliance with Method E (Martindale method) of JIS-L-1096 8.17.5 with the proviso that an abrasive opposing cloth was used for the hair canvas. The number of times the fabric was rubbed until a hole formed or the depletion rate reached 5% or more was measured.

(11) Air Permeability

Air permeability was measured in accordance with Method A (Frazier method) of JIS-L-1096 8.27.1. Units are in cc/cm$^2$·sec.

(12) Silicone Resin Processing

"Yes" was indicated in the case of silicone resin processing, while "No" was indicated in the absence of silicone resin processing.

(13) Fabric Texture (Softness)

Texture (softness) was evaluated as the average of the evaluations of five panelists (1: hard, 2: somewhat hard, 3: indeterminate, 4: somewhat soft, 5: soft).

(14) Fabric Texture (Smoothness)

Texture (smoothness) was evaluated as the average of the evaluations of five panelists (1: rough, 2: somewhat rough: 3: indeterminate, 4: somewhat smooth, 5: smooth).

Example 1

Figure 2:
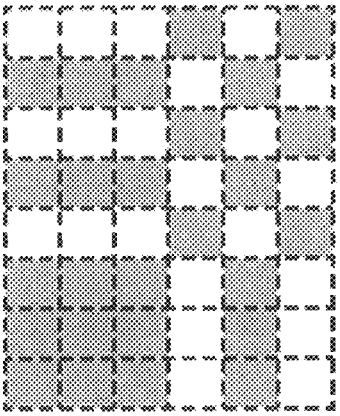
FIG. 2 shows an example of a structural drawing of a fabric of the present embodiment. Intersection points where warp yarn appears on the top side are shown in black.

Using 22 dtex, 24 filaments Nylon 6 fibers for the warp yarns and 22 dtex, 24 filaments Nylon 6 fibers for the weft yarns, a fabric having the rip-stop taffeta structure shown in FIG. 2 was woven with a water jet loom. After scouring and presetting the resulting woven fabric in accordance with ordinary methods, the fabric was dyed with a jet dyeing machine and dried, followed by coating with an emulsion consisting of 1% modified silicone resin in the form of Nicca Silicon DM-100E (Nicca Chemical Co., Ltd.) and 0.5% anionic surfactant according to the DIP and NIP method and then drying at 140° C. The coated amount of silicone resin was 0.8% by weight. Subsequently, hot calendaring processing was carried out twice while setting the temperature of the calendar on the surfaces of the metal/plastic rolls to 150° C., the calendaring pressure to 27 t/150 cm of width and the calendaring speed to 10 m/min.

The properties of the resulting woven fabric are shown in the following Table 1. The fabric exhibited little cold sensation when touched and had a soft texture.

Example 2

A fabric having a taffeta structure was woven with a water jet loom using 22 dtex, 24 filament Nylon 6 fibers for the warp yarns and 33 dtex, 26 filament Nylon 6 fibers for the weft yarns, followed by carrying out weaving and processing in the same manner as Example 1.

However, hot calendaring processing was carried out only once while setting the temperature of the calendar on the surfaces of the metal/plastic rolls to 145° C., the calendaring pressure to 27 t/150 cm of width and the calendaring speed to 15 m/min.

The properties of the resulting woven fabric are shown in the following Table 1. The woven fabric exhibited little cold sensation when touched and had a soft texture.

Example 3

A woven fabric having a rip-stop taffeta structure was woven in the same manner as Example 1 using 11 dtex, 8 filaments Nylon 66 fibers for the warp yarns and 17 dtex, 16 filaments Nylon 66 fibers for the weft yarns, followed by carrying out weaving and processing in the same manner as Example 1.

However, hot calendaring processing was carried out only once while setting the temperature of the calendar on the surfaces of the metal/plastic rolls to 150° C., the calendaring pressure to 27 t/150 cm of width and the calendaring speed to 15 m/min.

The properties of the resulting woven fabric are shown in the following Table 1. The woven fabric exhibited little cold sensation when touched and had a soft texture.

Example 4

A fabric having a rip-stop taffeta structure was woven and processed in the same manner as Example 1 using 11 dtex, 8 filaments Nylon 6 fibers for the warp yarns and 17 dtex, 16 filaments Nylon 6 fibers for the weft yarns.

Hot calendaring processing was carried out twice while setting the temperature of the calendar on the surfaces of the metal/plastic rolls to 160° C., the calendaring pressure to 20 t/150 cm of width and the calendaring speed to 10 m/min.

The properties of the resulting woven fabric are shown in the following Table 1. Although the woven fabric exhibited a somewhat cold sensation, the texture was soft.

Example 5

A fabric having a rip-stop taffeta structure was woven and processed in the same manner as Example 1 using 14 dtex, 6 filaments Nylon 66 fibers for the warp yarns and 14 dtex, 6 filaments Nylon 66 fibers for the weft yarns.

Hot calendaring processing was carried out three times while setting the temperature of the calendar on the surfaces of the metal/paper rolls to 160° C., the calendaring pressure to 35 t/150 cm of width and the calendaring speed to 10 m/min.

The properties of the resulting woven fabric are shown in the following Table 1. The woven fabric exhibited little cold sensation when touched and had a soft texture.

Example 6

A woven fabric having a rip-stop taffeta structure was woven and processed in the same manner as Example 1 using 17 dtex, 18 filaments polyester filaments having an intrinsic viscosity [η] of 0.87 for the both the warp yarns and weft yarns.

Hot calendaring processing was carried out once while setting the temperature of the calendar on the surfaces of the metal/paper rolls to 160° C., the calendaring pressure to 30 t/150 cm of width and the calendaring speed to 10 m/min followed immediately by cooling using a cooling roll.

The properties of the resulting woven fabric are shown in the following Table 1. The woven fabric exhibited little cold sensation when touched and had a soft texture.

Example 7

A woven fabric having a rip-stop taffeta structure was woven and processed in the same manner as Example 1 using 24 dtex, 18 filaments polyester filaments having an intrinsic viscosity [η] of 0.87 for the both the warp yarn and weft yarns.

Hot calendaring processing was carried out twice while setting the temperature of the calendar on the surfaces of the metal/paper rolls to 150° C., the calendaring pressure to 25 t/150 cm of width and the calendaring speed to 15 m/min.

The properties of the resulting woven fabric are shown in the following Table 1. The woven fabric exhibited little cold sensation when touched and had a soft texture.

Example 8

Processing was carried out in the same manner as Example 1 with the exception of not coating with the modified silicone resin of Example 1.

The properties of the resulting woven fabric are shown in the following Table 1. The woven fabric exhibited little cold sensation when touched, but had a hard texture and tear strength was weak.

Comparative Example 1

Processing was carried out in the same manner as Example 1 with the exception of carrying out hot calendaring processing once and using calendaring conditions consisting of a calendaring temperature of 165° C., calendaring pressure of 35 t/150 cm of width and calendaring speed of 10 m/min.

The properties of the resulting woven fabric are shown in Table 1. The woven fabric exhibited a considerable cold sensation when touched and had a hard texture.

Comparative Example 2

Processing was carried out in the same manner as Example 1 with the exception of carrying out hot calendaring processing once and using calendaring conditions consisting of a calendaring temperature of 120° C., calendaring pressure of 10 t/150 cm of width and calendaring speed of 20 m/min.

The properties of the resulting woven fabric are shown in the following Table 1. Although the woven fabric did not exhibit a cold sensation when touched, it demonstrated high air permeability.

Comparative Example 3

Processing was carried out in the same manner as Example 1 with the exception of using 33 dtex, 26 filaments Nylon 66 fibers for the warp yarns and 56 dtex, 48 filaments Nylon 66 fibers for the weft yarns and setting the calendaring temperature to 160° C.

The properties of the resulting woven fabric are shown in the following Table 1. The woven fabric was heavy and bulky.

TABLE 1

| | | Ex. 1 | Ex. 2 | Ex. 3 | Ex. 4 | Ex. 5 | Ex. 6 | Ex. 7 | Ex. 8 | Comp. Ex. 1 | Comp. Ex. 2 | Comp. Ex. 3 |
|---|---|---|---|---|---|---|---|---|---|---|---|---|
| Yarns used (dtex/F) | Warp | 22/24 | 22/24 | 11/8 | 11/8 | 14/6 | 17/18 | 24/18 | 22/24 | 22/24 | 22/24 | 33/26 |
| | Weft | 22/24 | 33/26 | 17/16 | 11/8 | 14/6 | 17/18 | 24/18 | 22/24 | 22/24 | 22/24 | 56/48 |
| Viscosity | Warp | 3.1 | 3.1 | 3.3 | 3.3 | 3.1 | 0.87 | 0.87 | 3.1 | 3.1 | 3.1 | 3.1 |
| | Weft | 3.1 | 3.1 | 3.3 | 3.3 | 3.1 | 0.87 | 0.87 | 3.1 | 3.1 | 3.1 | 3.1 |
| Density (yarns/inch) | Warp | 180 | 180 | 245 | 245 | 225 | 215 | 182 | 180 | 180 | 180 | 140 |
| | Weft | 174 | 140 | 210 | 240 | 220 | 210 | 175 | 174 | 174 | 174 | 105 |
| Calender roll | | Metal/ plastic | Metal/ plastic | Metal/ plastic | Metal/ plastic | Metal/ paper | Metal/ plastic | Metal/ plastic | Metal/ plastic | Metal/ plastic | Metal/ plastic | Metal/ plastic |
| Calendering temperature | ° C. | 150 | 145 | 150 | 160 | 160 | 160 | 150 | 150 | 165 | 120 | 160 |
| Calendering pressure | t/1.5 m | 27 | 27 | 27 | 20 | 35 | 30 | 25 | 27 | 35 | 10 | 27 |
| Calendering speed | m/min | 10 | 15 | 15 | 10 | 10 | 10 | 15 | 10 | 10 | 20 | 10 |
| Calendering index | | 7.4 | 2.4 | −6.1 | 11 | 3 | −1 | −9.5 | 7.4 | 16.5 | −16 | 1.4 |
| Outermost yarn flattening index X | | 0.61 | 0.67 | 0.7 | 0.55 | 0.64 | 0.65 | 0.72 | 0.63 | 0.5 | 0.8 | 0.8 |
| Non-outermost yarn flattening index Y | | 0.88 | 0.94 | 0.96 | 0.8 | 0.9 | 0.92 | 0.98 | 0.9 | 0.7 | 1 | 1 |
| Basis Weight | ($g/m^2$) | 34 | 38 | 30 | 27 | 31 | 32 | 35 | 33 | 34 | 34 | 51 |
| Thickness | mm | 0.065 | 0.066 | 0.055 | 0.048 | 0.065 | 0.06 | 0.062 | 0.065 | 0.045 | 0.078 | 0.087 |
| Intersection points | Quantity | 31320 | 25200 | 51450 | 58800 | 49500 | 45150 | 31850 | 31320 | 31320 | 31320 | 14700 |
| Friction coefficient average deviation | | 0.02 | 0.012 | 0.045 | 0.009 | 0.048 | 0.025 | 0.48 | 0.035 | 0.007 | 0.06 | 0.03 |
| Qmax | $W/m^2 \cdot$ ° C. | 110 | 115 | 90 | 122 | 88 | 115 | 98 | 103 | 130 | 78 | 105 |
| Filling rate | % | 46 | 51 | 48 | 49 | 42 | 47 | 40 | 45 | 66 | 38 | 51 |
| Tear strength (N) | Warp | 13 | 9 | 13 | 11 | 13 | 12 | 11 | 7 | 11 | 10 | 11 |
| | Weft | 11 | 8 | 12 | 10 | 12 | 10 | 9 | 5 | 9 | 8 | 10 |
| Abrasion strength | | 28000 | 16000 | 22000 | 25000 | 19000 | 15000 | 13000 | 19000 | 22000 | 18000 | 25000 |
| Air permeability | ($cm^3/cm^2 \cdot sec$) | 0.7 | 0.8 | 1.4 | 0.4 | 1.3 | 0.7 | 1.3 | 1.7 | 0.3 | 1.8 | 1.7 |
| Structure (texture) | | Rip-stop | Taffets | Rip-stop | Rip-stop | Rip-stop | Rip-stop | Rip-stop | Rip-stop | Rip-stop | Rip-stop | Rip-stop |
| Silicon resin processing | | Yes | Yes | Yes | Yes | Yes | Yes | Yes | No | Yes | Yes | Yes |
| Fabric texture | Softness | 4.6 | 4.2 | 4.6 | 3.8 | 4.2 | 4.4 | 4 | 1.4 | 1.6 | 4.4 | 1.8 |
| Fabric texture | Smoothness | 4.6 | 4.2 | 3.2 | 4.8 | 4.6 | 4.2 | 4.4 | 1.4 | 4.6 | 1.6 | 3.8 |

INDUSTRIAL APPLICABILITY

The woven fabric of the present invention is a smooth, soft and comfortable fabric that demonstrates superior comfort during contact, does not exhibit a cold sensation when worn or used, and retains heat to a certain extent despite being extremely lightweight and thin, while also demonstrating superior tear strength and abrasion strength and having superior down-proofing properties, thereby enabling it to be used preferably as a woven fabric for sportswear such as down jackets or windbreakers, as a ticking for a sleeping bag or futon, or a woven fabric for the inner bag thereof.

The invention claimed is:

1. A method for producing a thin woven fabric composed of warp yarns and weft yarns and having a basis weight of 15 $g/m^2$ to 50 $g/m^2$ wherein thermoplastic synthetic fibers having fineness of 5 dtex to 30 dtex are arranged in at least a portion of the warp yarns or weft yarns, said thermoplastic synthetic fibers are selected from the group consisting of Nylon 6 and Nylon 66 fibers, the cross-sectional shape of the single yarn of the warp yarns and weft yarns is circular, the average deviation of the coefficient of friction on at least one side of the fabric is 0.008 to 0.05, the value of Qmax of that one side of the fabric is 85 $W/m^2 \cdot °C.$ to 125 $W/m^2 \cdot °C.$, air permeability of the fabric is 0.3 $cc/cm^2 \cdot sec$ to 1.5 $cc/cm^2 \cdot sec$, a yarn flattening index X of yarns composing the outermost surface on the surface side of the thin woven fabric having higher smoothness is 0.75 or less, and a yarn flattening index Y of yarns not composing the outermost surface is 0.8 to 1.0, the method comprising the steps of:

weaving a fabric, dyeing and drying the woven fabric, and subsequently calendering the woven fabric using calender rolls wherein a metal roll and an elastic roll are combined, under conditions such that when glass transition temperature of the thermoplastic synthetic fibers selected from the group consisting of Nylon 6 and Nylon 66 fibers is defined as TG (° C.), melting point is defined as TM (° C.), calender roll temperature is defined as T (° C.), calender roll pressure is defined as P (t/150 cm) and calender roll speed is defined as S (m/min), wherein TG is 47° C. and TM is 225° C. in the case of Nylon 6 and TG is 49° C. and TM is 267° C. in the case of Nylon 66, the calendering index defined by $\{T-(TG+TM)/2\}/2+\{(P-25)/5\}+\{(10-S)/2\}$ is −12 to 11 to obtain the fabric.

2. The method according to claim 1, wherein the calender roll temperature is (TG+TM)/2−20 to (TG+TM)/2+30 (° C.).

3. The method according to claim 1, wherein a silicone resin is attached to the thin woven fabric.

4. The method according to claim 1, wherein the filling rate of the thin woven fabric is 35% to 65%.

5. The method according to claim 1, wherein the tear strength of the thin woven fabric is 8 N to 20 N.

* * * * *